United States Patent [19]

Krömer

[11] 4,304,200

[45] Dec. 8, 1981

[54] FUEL INJECTION SYSTEMS FOR MIXTURE COMPRESSING SPARK-IGNITION INTERNAL COMBUSTION ENGINE

[75] Inventor: Günter Krömer, Heilbronn, Fed. Rep. of Germany

[73] Assignee: Audi NSU Auto Union Aktiengesellschaft, Fed. Rep. of Germany

[21] Appl. No.: 125,359

[22] Filed: Feb. 28, 1980

Related U.S. Application Data

[63] Continuation of Ser. No. 946,575, Sep. 28, 1978, abandoned.

[30] Foreign Application Priority Data

Oct. 25, 1977 [DE] Fed. Rep. of Germany ..... 2747806

[51] Int. Cl.[3] ..... F02P 9/00; F02B 23/00

[52] U.S. Cl. ..... 123/327; 123/335; 123/340; 123/585

[58] Field of Search ..... 123/319, 327, 334, 340, 123/585–589, 325, 335

[56] References Cited

U.S. PATENT DOCUMENTS

| | | | |
|---|---|---|---|
| 2,886,020 | 5/1959 | Wolfe | 123/327 |
| 3,601,103 | 8/1971 | Swiden | 123/198 D |
| 3,821,943 | 7/1974 | Toda et al. | 123/327 |
| 3,906,909 | 9/1975 | Garcea | 123/320 |
| 3,983,849 | 10/1976 | Stumpp | 123/586 |
| 4,078,631 | 3/1978 | Kadota et al. | 123/335 |
| 4,203,395 | 5/1980 | Cromas et al. | 123/585 |

*Primary Examiner*—Craig R. Feinberg
*Attorney, Agent, or Firm*—Kane, Dalsimer, Kane, Sullivan and Kurucz

[57] ABSTRACT

A fuel injection system for a mixture-compressing spark-ignition internal combustion engine includes an air suction pipe, a throttle valve located in the pipe, and a member upstream of the throttle valve, which is actuatable by air flowing through the suction pipe so as to move a piston valve to dose a quantity of fuel to a fuel injection nozzle. The system includes a duct which bypasses the throttle valve, the duct having a valve which closes the duct when the throttle valve is closed and when the engine is above the idling speed. The duct valve is operatively connected to a switching member which switches off the ignition system of the engine.

3 Claims, 1 Drawing Figure

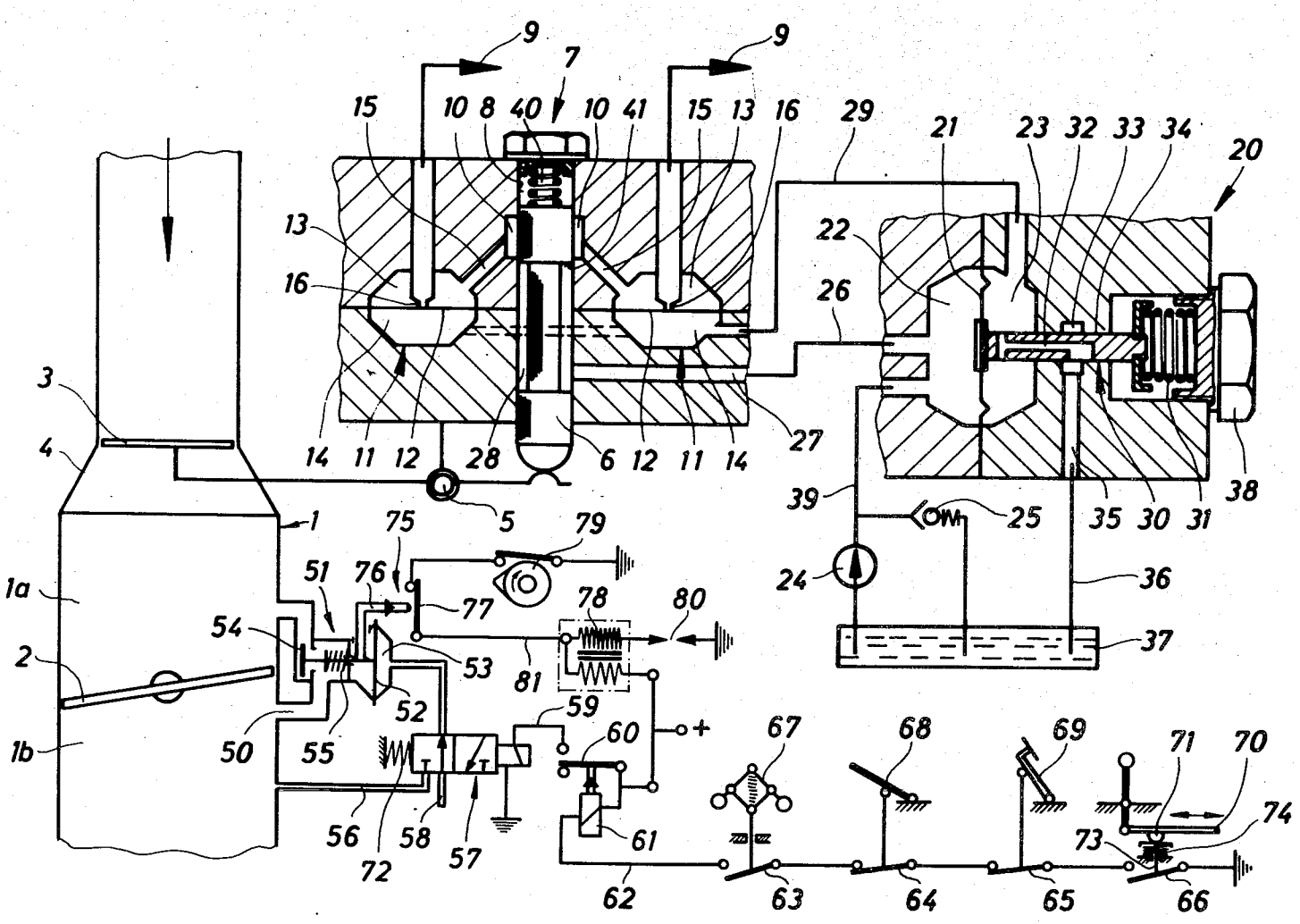
20
38
31
34
30
33
36
37
35
32
23
25
21
22
26
29
39
24
27
9
16
13
14
15
11
41
12
10
6
7
40
8
28
5
1
3
4
1a
2
1b
70
74
71
66
73
69
65
68
64
67
63
62
61
60
80
78
79
59
81
77
53
57
58
75
52
76
72
56
51
55
54
50

FUEL INJECTION SYSTEMS FOR MIXTURE COMPRESSING SPARK-IGNITION INTERNAL COMBUSTION ENGINE

This is a continuation of application Ser. No. 946,575, filed Sept. 28, 1978, now abandoned.

BACKGROUND OF THE INVENTION

This invention relates to a fuel injection system for a mixture-compressing spark-ignition internal combustion engine.

According to our copending U.S. patent application Ser. No. 915,676, now U.S. Pat. No. 4,243,002, the fuel dosing to an internal combustion engine is cut off as soon as coasting commences in order to prevent excess fuel consumption and the formation of particles of detrimental material in the exhaust gas, and also to avoid an uneven performance. In order to obtain reliable fuel cut-off, the valve in the bypass duct is actuated only if all criteria of the coasting operation exist, that is to say, an engaged clutch, engaged gear, closed throttle valve and an engine speed which is above the idling speed.

It has now been shown that in spite of the fuel supply being cut-off, uneven ignition can still occur in the initial operational phases of coasting, as a result of a slight fuel residue present in the suction pipe or in the internal combustion engine, and this can lead to a sequence of combustion which is uneven and which considerably disturbs the operation of the internal combustion engine.

The object of the invention is to modify the mode of operation of an internal combustion engine having a fuel injection system as described in copending U.S. patent application Ser. No. 915,676 in such a way that combustion during coasting is more efficiently checked.

Broadly speaking, the invention provides a fuel injection system for a mixture compressing spark-ignition internal combustion engine having continuous fuel injection, comprising a suction pipe; a throttle valve located in said suction pipe; a member upstream of said throttle valve, said member being actuatable by air flowing through said suction pipe so as to dose fuel to the engine; a duct which by-passes said throttle valve; a duct valve located in the duct which closes off the duct when the throttle valve is closed and when the engine speed is above the idling speed, said duct valve being operatively connected to a switching member for switching off the ignition system of the engine when said duct valve is in its shut-off position.

By means of the invention, it is possible to prevent combustion when the coasting operation of the internal combustion engine starts, so that a smooth running of the internal combustion engine is ensured. Actuation of the switching member directly by the duct valve has the advantage that ignition is cut-off reliably and simultaneously with the shutting-off of the fuel supply.

Preferably, the switching member is located in the primary circuit of the ignition system, or in the line between the high-voltage generator and the contact breaker.

BRIEF DESCRIPTION OF THE DRAWINGS

The invention may be performed in various ways, and a specific embodiment is now described with reference to the accompanying drawing, which is a diagrammatic section of a fuel injection and ignition device for an internal combustion engine.

DETAILED DESCRIPTION

Referring to the drawing, there is shown a suction pipe of a mixture-compressing, externally ignited vehicle internal combustion engine, the pipe containing a voluntarily operable throttle valve 2 and a measuring member 3 which is actuated by air flowing through the pipe 1 in the direction of the arrow. The measuring member 3 is in the form of a baffle plate 3 and is located at the upper end of a conical section 4 of the suction pipe 1. The baffle plate 3 is pivotally mounted on a shaft 5 and actuates a movable piston valve 6 of a fuel dosing valve 7. The piston valve 6 is located in a cylindrical bore 8, in whose wall a number of guide slots 10 are provided corresponding to the number of injection nozzles indicated by arrows 9. To each guide slot 10 is connected a constant pressure valve 11, which has two chambers 13 and 14 separated from one another by a diaphragm 12. Each chamber 13 is connected via a duct 15 to a corresponding guide slot 10, and via a valve aperture 16, which is controlled by a diaphragm 12, to an injection nozzle 9. Common to all the constant pressure valves 11 is a differential pressure regulating valve 20, which has two chambers 22 and 23 which are separated from each other by a diaphragm 21. The chamber 22 is charged by an electrically driven fuel pump 24 with fuel under system pressure, which is determined by a system pressure retaining valve 25. The chamber 22 communicates via a pipeline 26 and a duct 27 with an annular groove 28 in the piston valve 6 of the fuel dosing valve 7. The second chamber 23 of the differential pressure regulating valve 20 is connected by a line 29 to the second chambers 14 of all the constant pressure valves 11. The pressure is the chamber 23, which determines the differential pressure at the dosing valve 7, is controlled by a valve body 30, which is pressed by a spring 31 against the diaphragm 21 of the differential pressure regulating valve 20 and has a bore 32 which is in communication with the chamber 23 and which, according to the position of the valve body 30, communicates with an annular groove 33 in the wall of the bore 34 which accepts the valve body 30. The annular groove 33 is in communication with the fuel tank 37 via a duct 35 and a backflow pipeline 36. The tension in the spring 31, which can be adjusted by a screw 38, determines the height of the differential pressure at the dosing valve 7.

The fuel which is conveyed by the fuel pump 24 passes through the pipeline 39 into the first chamber 22 of the differential pressure regulating valve 20, and from there through the pipeline 26 and the duct 27 into the annular groove 28 of the piston valve 6. The piston valve 6 is moved upwards by downward movement of the baffle plate 3, depending upon its deflection by the quantity of air flowing through the suction pipe 1, counter to an adjusting force which is produced by a spring 40. The upward movement of guide 6 permits guide edge 41 to move to a position where groove 28 communicates with the guide slots 10. The fuel in groove 28 now passes through the slots 10 and ducts 15 into the first chambers 13 of the constant pressure valves 11, from where it flows through the valve apertures 16 to the appropriate injection nozzles 9.

The suction pipe 1 is provided with a duct 50 which by-passes the throttle valve 2, and which connects the suction pipe section **1*a* lying upstream of the throttle valve 2 to the suction pipe section 1*b* which is downstream of the throttle valve 2. The air quantity which is necessary for the idle running of the internal combustion engine can flow through the duct 50 when the throttle valve 2 is closed, whereby this air produces a deflection of the baffle flap 3, the result of which is a corresponding dosing of fuel to the injection nozzles 9 through the fuel dosing valve 7**.

In order to shut off the fuel supply and switch off the ignition during coasting, a duct valve 51 is provided which during coasting disconnects both the duct 50 and the ignition. Any noticeable air flow through the suction pipe 1 is thereby prevented and a deflection of the baffle flap 3 is prevented, whilst any further ignition also ceases as a result. The duct valve 51, which cooperates both with the duct 50 and with a switching member 75, is in the form of a diaphragm valve having a diaphragm 52 which defines a low pressure chamber 53 and is connected to a valve body 54 which is normally raised from its seat by a spring 55. The chamber 53, during coasting, is connected by a pipeline 56 to the suction pipe section 1*b* downstream of the throttle valve 2, and the low pressure which then prevails in the chamber 53 overcomes the force of the spring 55 and draws the valve body 54 onto its seat, whereby the duct 50 is shut off and the ignition is switched off by the switching member 75. The switching member 75 is composed of a trip cam 76 which is firmly connected to the valve body 54 or the diaphragm 52, and a switch 77, which is normally closed and is situated in the primary circuit 81 between the high-voltage generator 78 and the contact breaker 79. When the switch 77 is opened by the trip cam 76, the ignition is switched off and the operation of the sparking plug 80 is suspended.

The pipeline 56 is controlled by a three-way solenoid valve 57, which adopts the position shown, in all operating states with the exception of coasting, in which the low pressure chamber 53 is connected to a ventilating pipeline 58 which opens into the atmosphere, so that the duct valve 51 keeps the duct 50 open and the switch 77 closed. In the circuit 59 of the exciting winding of the solenoid valve 57 is located a switch 60 of a relay 61, which closes the circuit 59 when the relay 61 is excited and brings the solenoid valve 67 into the second position, in which the low pressure chamber 53 is connected via the pipeline 56 to the suction pipe section 1*b*.

Four switches 63, 64, 65 and 66 are connected in series in the circuit 62 of the relay 61. The switch 63 is under the influence of a symbolically indicated speed regulator 67 and is closed when the engine speed is above the idling speed. The switch 64 is connected to the accelerator pedal 68 or to a lever system leading from the latter to the throttle valve 2, and is closed when the throttle valve 2 is closed. The switch 65 is connected to the clutch pedal 69 or another part of the clutch actuating means and it is closed when the clutch is in the engaged position. The switch 66 is actuated by the gear shift system 70 of the gearbox in such a way that it is opened when the gearbox is in the idling position, but is closed when one gear is engaged.

The position of the switches 63 to 66 which is shown corresponds to the idling state of the vehicle drive. The engine speed corresponds to the idling speed, so that the switch 63 is opened. The accelerator pedal 68 is relieved, so that the switch 64 is closed. The clutch pedal 69 is not loaded, and therefore the clutch engaged, so that the switch 65 is closed. The gear mechanism is in its idling position, in which the cam 71 on the gearshift linkage 70 opens the switch 66. The circuit 62 of the relay 61 is broken by the open switches 63 and 66, the switch 60 is therefore opened, and the winding of the solenoid valve 57 is currentless, whereby the solenoid valve is pressed by means of the spring 72 into the position shown, in which the low pressure chamber 53 of the duct valve 51 is ventilated and the low pressure pipeline 56 is shut off. The duct 50 is therefore opened and the baffle flap 3 is deflected, depending upon the air flow during idling, in order to dose an appropriate quantity of fuel, whilst the switch 77 is closed and the ignition is therefore switched on. In every other operating state, with the exception of coasting, at least one of the switches 63 to 66 is also opened, so that the duct valve 51 is in the position shown. During coasting, on the other hand, the engine speed is above the idling speed, so that the switch 63 is closed. The accelerator pedal 68 is at rest and the switch 64 is therefore closed. The clutch is engaged and the switch 65 is closed. Finally, the switch 66 is also closed, as one gear of the gear box is engaged and at the same time, the cam 71 releases the rod 73 of the switch 66, and the latter, by the action of the spring 74, can reach its closing position. During coasting the circuit 62 of the relay 61 is thus closed, whereby the switch 60 closes the circuit 59 of the solenoid valve 57 and the solenoid valve is moved to the left in the drawing, counter to the action of the spring 72. In this position, the low pressure chamber 53 of the duct valve 51 is connected to the suction pipe section 1*b*, whereby not only is the valve body 54 drawn onto its seat and the duct 50 closed, but the trip cam 76 opens the switch 77 and switches off the ignition.

Several modifications of the exemplified embodiment are obviously possible without any departure from the framework of the invention. In one simplified construction, the switches 65 and 66 can be omitted, but there then exists the possibility of erroneous operation and unintentional shutting-off of the fuel supply or switching-off of the ignition if the accelerator pedal 68 is pressed down for a short while in the idling position of the gearbox or when the clutch is disengaged, whereby the engine speed is raised above the idling speed and then released again. The speed-dependent switch 63 is thereby closed, and—as the accelerator pedal 68 has returned to its resting position—the circuit 62 is closed, whereby the duct valve 51 is actuated, until the engine speed has fallen to the idling speed and the switch 63 is opened again. In another modified exemplified embodiment, it would also be possible to locate the switch 77 inside the stop valve 51. The switch 77 can, however, also be coupled to the switch 60 in such a way that the circuit 81 is opened when the circuit 59 is closed.

The relay 61 and the switch 60 are provided merely for reasons of circuit technology. It would be possible to connect the switches 63 and 66 directly into the circuit 59 of the solenoid valve 57. It would also be conceivable, instead of the diaphragm valve 51, to provide a solenoid valve, into whose circuit the switches 63 to 66 could be connected up. Because of the smoother reaction of a diaphragm valve, however, the latter is preferred.

What is claimed is:

1. A fuel injection system for a mixture-compressing, spark-ignition internal combustion engine for use with a vehicle having an ignition system having a primary circuit, a clutch and a gear box, comprising: a suction pipe; a throttle valve located in said suction pipe; an air sensor disposed in said suction pipe upstream of said throttle valve and displaceable by air flowing through said suction pipe; a fuel metering valve operable by said air sensor; an air duct which by-passes said throttle valve; a duct valve within said air duct, and means for closing said duct via said duct valve only when at the same time the throttle valve is closed, the clutch is engaged, a gear of said gear box is engaged and the engine speed is above the idling speed, said duct valve being operatively connected independent of said closing means to a switching member for switching off the ignition system of the engine when said duct valve is in its position wherein it closes said air duct.

2. A combination as claimed in claim 1, in which the switching member is located in the primary circuit of the ignition system.

3. A combination as claimed in claim 2, in which the switching member is located in a line between a high-voltage generator and a contact breaker of the ignition system.

* * * * *